US006516731B1

(12) United States Patent
Park

(10) Patent No.: US 6,516,731 B1
(45) Date of Patent: Feb. 11, 2003

(54) CLASSROOM DESK

(76) Inventor: Hyuk Koo Park, 801-801 Beoksan Hansung Apt., 1267 Kwonsun-dong, Kwonsun-gu, Suwon-shi, Kyonggi-do (KR)

( * ) Notice: Subject to any disclaimer, the term of this patent is extended or adjusted under 35 U.S.C. 154(b) by 0 days.

(21) Appl. No.: 09/967,984

(22) Filed: Oct. 2, 2001

(51) Int. Cl.[7] ..... B30B 3/00
(52) U.S. Cl. ..... 108/153.1; 108/13
(58) Field of Search ..... 108/157.1, 153.1, 108/158, 158.13, 156, 157.15, 180, 13

(56) References Cited

U.S. PATENT DOCUMENTS 1,422,613 A * 7/1922 Ogden
2,602,012 A * 7/1952 Doty
3,059,779 A 10/1962 Killam, Jr.
3,880,097 A * 4/1975 Camilleri
5,802,990 A * 9/1998 Lin

FOREIGN PATENT DOCUMENTS

EP 1049499 11/1966
EP 1591032 6/1981

* cited by examiner

*Primary Examiner*—Jose V. Chen
(74) *Attorney, Agent, or Firm*—McDermott, Will & Emery

(57) ABSTRACT

A classroom desk, the desk having an article pad coupled to upper sides of props and supports, an upper plate attached to an upper side of the artical pad and a fixing unit for fixing the article pad and the upper plate to the props, wherein the fixing unit comprises: a first fixing pin for penetrating an upper end of the props and periphery of the article pad to be fitted into the upper plate; and a second fixing pin for being fitted into an upper side of the upper plate to be threaded to the first fixing pin, such that the upper plate can be simply and swiftly replaced and can be reversely used without being scarred on the article pad and a bottom surface of the upper plate while the fixing unit for fixing the upper plate can be prevented from being unscrewed and there leave no traces of the upper plate having been secured, thereby reducing waste of material cost and upkeep cost, and beautifying an exterior look of the classroom desk.

4 Claims, 3 Drawing Sheets

CLASSROOM DESK

BACKGROUND OF THE INVENTION

1. Field of the Invention

The present invention relates to a classroom desk, and more particularly to a structure of fixed part at an upper plate of classroom desk.

2. Description of the Prior Art

Generally, classroom desks are inexpensive, and easy for assembly due to simple structure in an article pad, an upper plate and two supports buttressing the pad and the upper plate calls for frequent changes due to growing students' scribbling or applying damage thereto, resulting in much expenditure for up keeping same.

In a classroom desk according to the prior art, an article pad 4 is formed therein with an accommodation space and is extended externally at both upper ends thereof where the article pad 4 is abutted onto a bottom surface of an upper plate 6 and coupled by screws 8. The article pad 4 and the upper plate 6 thus coupled are fitted to upper ends of struts 2 and 2' and fixed by bolts 10 and nuts 10'.

However, there is a problem in the classroom desk according to the prior art thus described in that, when bolts 10 and nuts 10' are unscrewed in order to replace the upper plate 6, the article pad 4 and the upper plate 6 are separated in coupled state therebetween, and because the article pad 4 and the upper plate 6 are separated by unscrewing the screws 8 in the state thus explained, replacement process of the upper plate is much delayed and simultaneously there are many cases where the article pad 4 is damaged in the process of separation.

There is another problem in that, once an upper surface of the upper plate 6 is damaged, traces or impressions of screws used for fixing the article pad 4 remain unerased on the upper plate to leave uneven thereon, such that extended use of the desk is not possible as bottom surface of the upper plate 6 cannot be reused as an upper surface of the desk.

There is still another problem in that the article pad 4 and upper plate 6 are detached when mischievous students unscrew the nuts 10'.

SUMMARY OF THE INVENTION

The present invention is disclosed to solve the aforementioned problems and it is an the object of the present invention to provide a classroom desk constructed to expedite an easy and swift replacement of upper plate and to prevent damage to an article pad as well.

It is another object of the present invention to provide a classroom desk adapted to prevent damage to bottom surface of upper plate, thereby enabling to use the bottom surface of upper plate as upper surface.

It is still further object of the present invention to provide a classroom desk adapted to prevent unscrewing of fixing means for fixing an upper plate.

In accordance with the objects of the present invention, there is provided a classroom desk, the desk having an article pad coupled to upper sides of props and supports, an upper plate attached to an upper side of the article pad and fixing means for fixing the article pad and the upper plate to the props, wherein the fixing means comprises:

a first fixing pin for penetrating an upper end of the props and periphery of the article pad to be fitted into the upper plate; and a second fixing pin for being fitted into an upper side of the upper plate to be threaded to the first fixing pin.

It is preferable that the second fixing pin is formed thereon with a wrench groove for assembly.

It is also preferable that the second fixing pin is assembled at an upper surface there at lower state than that of upper surface of the upper plate while the second fixing pin is covered thereon by a cap having a protruder to be inserted into the wrench groove for assembly to fill up an upper space of the second fixing pin.

It is further preferable that the article pad is fixed to an upper inner surface of the props or to an upper surface of the supports by fixing screws.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
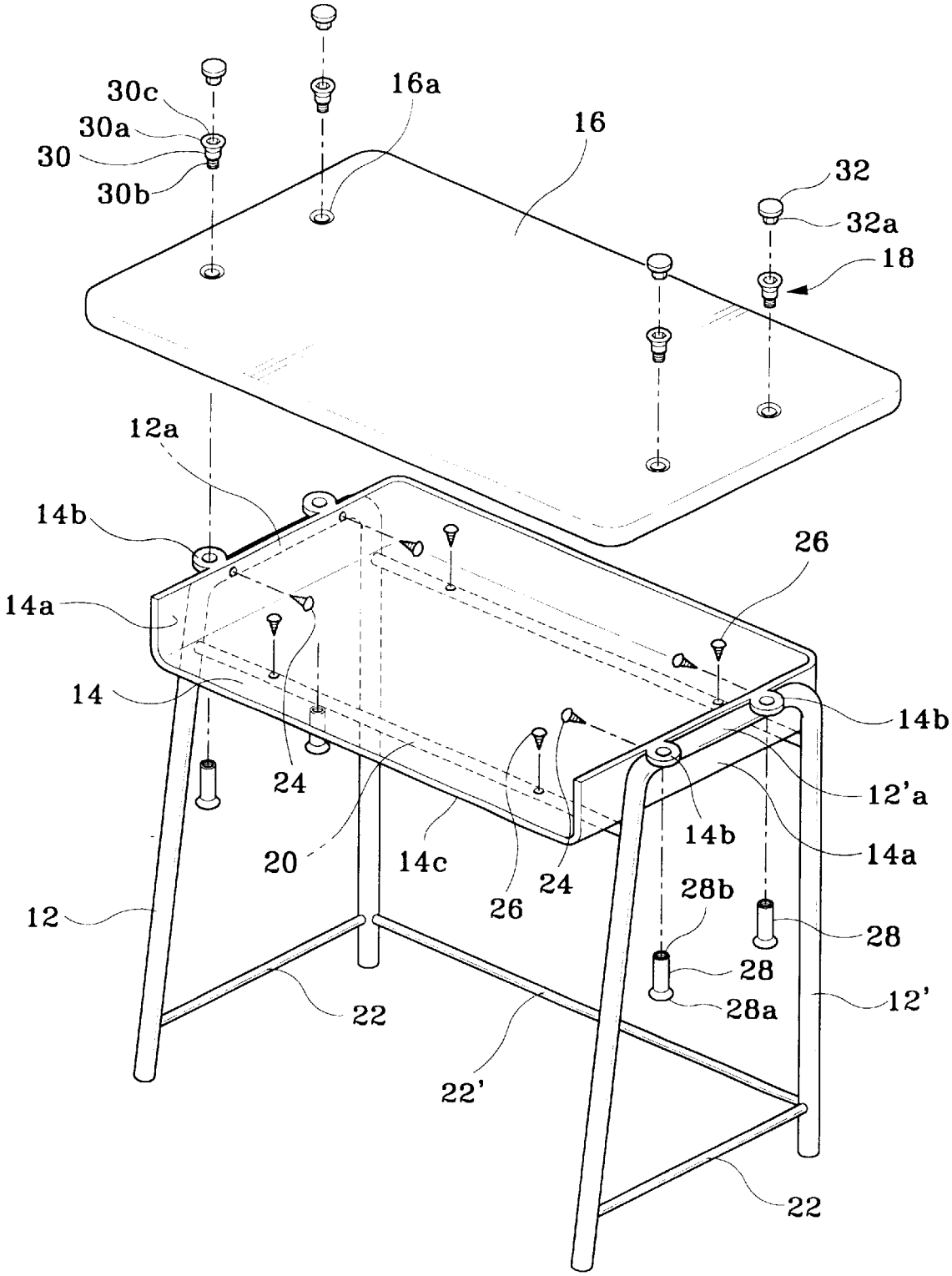
FIG. 1 is a separated perspective view of classroom desk according to an embodiment of the present invention.
Figure 2:
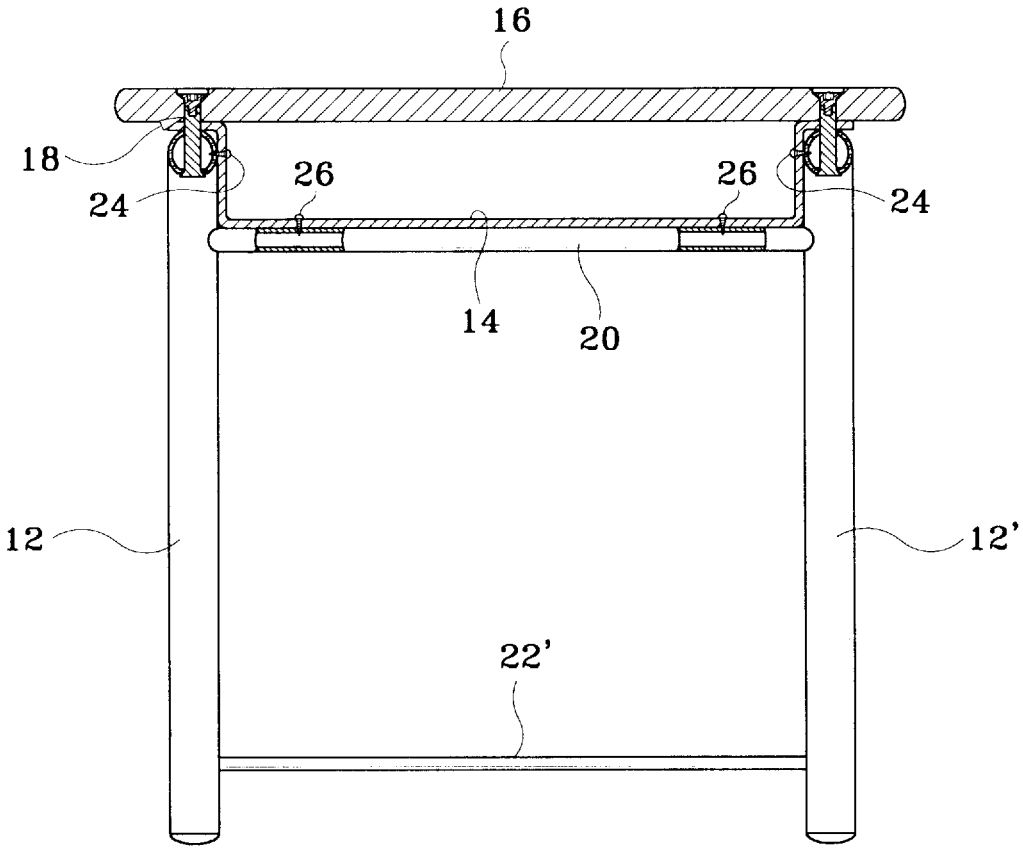
FIG. 2 is an assembled elevation of classroom desk according to embodiment of the present invention.

The classroom desk according to the present invention includes, as illustrated in FIGS. 1 and 2, props 12 and 12', an article pad 14 coupled to upper sides of the props 12 and 12', an upper plate 16 abutted to an upper side of the article pad 14 and fixing means 18 for fixing the article pad 14 and the upper plate 16 to the props 12 and 12'.

The props 12 and 12' are erected at both sides on which the props 12 and 12' are connected by a support 20, while interval keeping bars 22 and 22' connect the props 12 and 12' thereunder.

The props 12 and 12' are pipes having a trapezoidal shape opened thereunder of having a bent "⊂" shape and horizontal parts 12*a* and 12'*a* thereon are hitched by the article pad (14, described later). The horizontal parts 12*a* and 12'*a* are formed with holes for insertion by a headed first fixing pin (described later) of fixing means.

The support 20 is located approximately at a point lowered as much as height of a lateral plate unit (described later) of the article pad 14 from the horizontal parts 12*a* and 12'*a* of the props 12 and 12'. The article pad 14 has a shape of dustpan opened at front thereof and is equipped with extension parts 14*b* externally protruded from upper margins of both lateral plate units 14*a*.

The extension part 14*b* is hitched b upper ends of horizontal parts 12*a* and 12'*a* of the props 12 and 12' and is centrally formed with a headed first fixing pin (described later) of the fixing means.

Furthermore, both lateral plate units 14*a* are securely fixed at upper margins thereof by the upper ends of the horizontal parts 12*a* and 12'*a* of the props 12 and 12' via fixing screws 24. A bottom plate unit 14*c* of the article pad 14 is secured to the supports 20 by fixing screws 26. The upper plate 16 is a square plate formed with holes 16*a* into which the fixing means 18 are coupled. Marginal profile of the upper plate 16 may come in various shapes.

Figure 3:
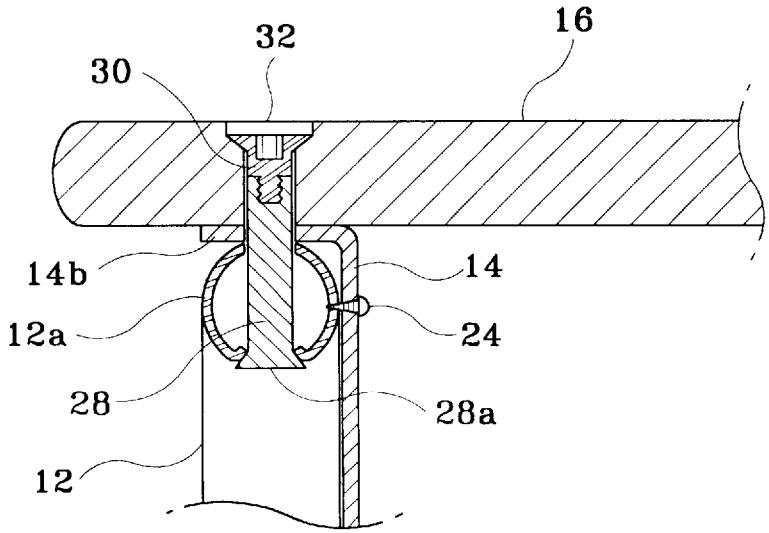
FIG. 3 is a sectional view of a fixation unit of an upper plate in FIG. 2.
Figure 4:
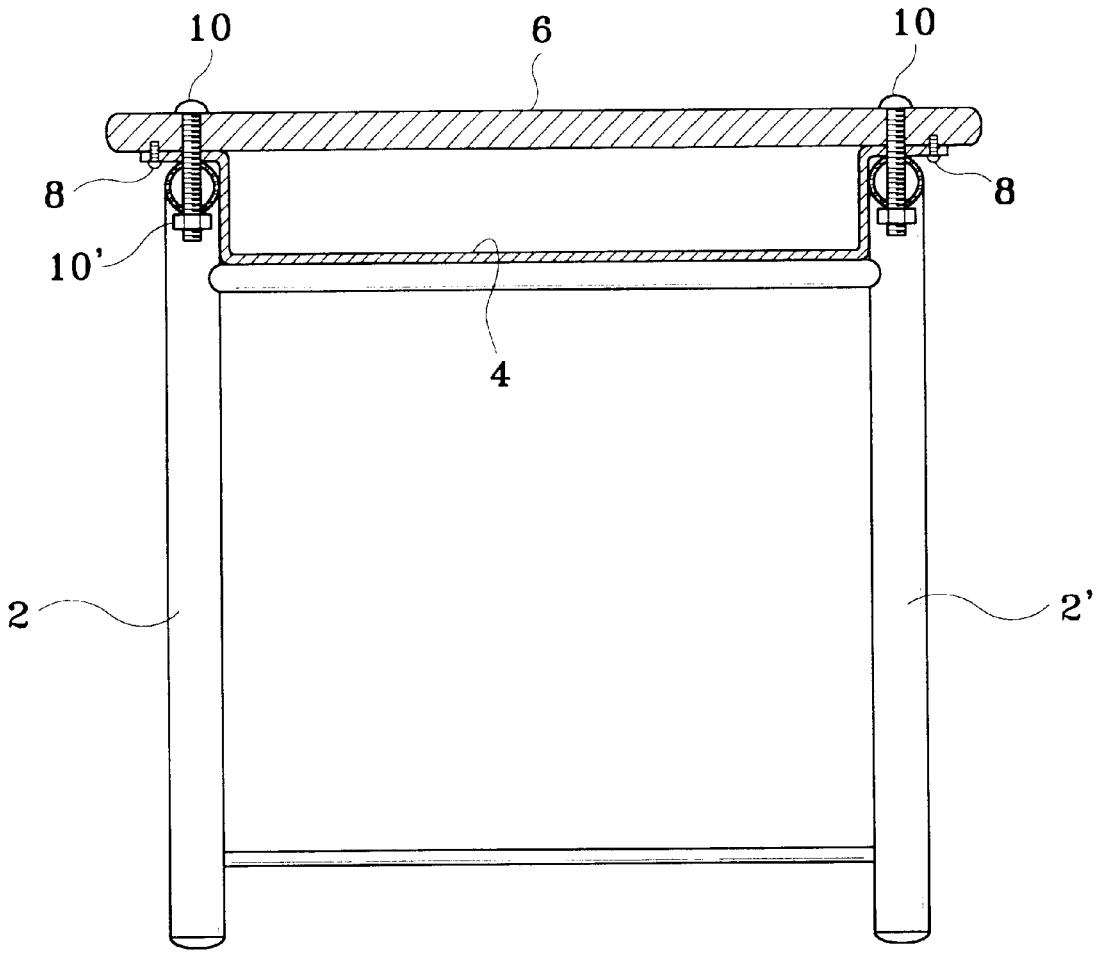
FIG.4 (Prior art)
FIG. 4 is an assembled elevation of classroom desk according to the prior art.

As illustrated in FIGS. 1 and 3, the fixing means 18 includes a headed first fixing pin 28 for penetrating marginal areas (extension parts 14*b*) of the article pad 14 and upper horizontal parts 12*a* and 12'*a* of the props 12 and 12' to be inserted into holes 16*a* of the upper plate 16, and a headed second fixing pin 30 inserted into upper side of holes 16*a* at the upper plate 16 to be threaded into the first fixing pin 28.

Head 28*a* of the first fixing pin 28 is of a dish shape and opposite side of the head 28*a* is formed with female screw 28*b* into which male screw (described later) of the second fixing pin 30 is coupled.

Head 30*a* of the second fixing pin 30 is also of a dish shape and opposite side of the head 30*a* is formed with male screw 30*b* for being threaded with female screw 28*b* of the first fixing pin 28. The head 30*a* is formed thereon with a wrench groove 30*c* for assembly.

Upper surface of the head 30*a* at the second fixing pin 30 is assembled in a state lower than upper surface of the upper plate 16 while the second fixing pin 30 is covered thereon by a cap 32 having a protruder 32*a* for insertion into the wrench groove 30*c* for assembly, to thereby fill up a space at an upper side of the second fixing pin, whereby the upper plate 16 is left with no trace or impression of fixation.

Although the present embodiment has described about the upper plate 16 processed by countersinking at one side thereof for insertion by the dishy head of the second fixing pin 30, the other side of the upper plate 16 may be processed by countersinking in anticipation of reversed use of the upper plate 16.

Furthermore, although the present embodiment has described about the first and second fixing pins 28 and 30 with respective heads thereon, the first and second fixing pins 28 and 30 may be constructed to be mounted at respective end thereof with separate hitching units (by way of example, split pins, protruders and the like).

In the classroom desk thus constructed, when the cap 32 is opened, and a wrench is inserted into the wrench groove 30*c* at the second fixing pin 30 for easy unscrewing of the fixing means 18, the upper plate 16 can be simply taken off to be replaced or reused by reversing.

At this time, the article pad 14 is secured to the props 12 and 12' and the supports 20 by fixing screws 24 and 26 such that there is no need to touch the article pad 14.

Furthermore, the upper plate 16 is free of scars or flaws except the holes into which the first and second fixing pins 28 and 30 are inserted such that there is the same effect as having used a new upper plate even though the upper plate 16 is reversely used. Still furthermore, the fixing means are covered by the caps to thereby be unseen, preventing students from unscrewing the fixing means.

The present invention is not limited to the given embodiment but may be embodied in many modifications and variations in light of the above teaching.

As apparent from the foregoing, there is an advantage in the classroom desk thus described according to the present invention in that an upper plate can be simply and swiftly replaced and can be reversely used without being scarred on an article pad and a bottom surface of the upper plate.

There is another advantage in that fixing means for fixing the upper plate can be prevented from being unscrewed and there leave no traces of the upper plate having been secured, thereby reducing waste of material cost and upkeep cost, and beautifying an exterior look of the classroom desk.

What is claimed is:

1. A classroom desk comprising:

an article pad coupled to upper sides of props and supports;

an upper plate attached to an upper side of the article pad; and fixing means for fixing the article pad and the upper plate to the props, wherein the fixing means comprises:

a first fixing pin for penetrating an upper end of the props and periphery of the article pad to be fitted into the upper plate, the first fixing pin having a female screw at the end thereof; and a second fixing pin for being fitted into an opening in an upper side of the upper plate, the second fixing pin having a male screw coupled to the female screw at the end thereof to press and fix the article pad and the upper plate to the props.

2. The desk as defined in claim 1, wherein the second fixing pin is formed thereon with a wrench groove for assembly.

3. The desk as defined in claim 2, wherein, when the desk is assembled, the second fixing pin is fitted in the opening in the upper side of the upper plate so that an upper surface of the second fixing pin is positioned lower than that of the upper surface of the upper plate, and the second fixing pin is covered by a cap having a protruder to be inserted into the wrench groove to fill up a space between the upper surface of the second fixing pin and the upper surface of the upper plate.

4. The desk as defined in claim 1, wherein the article pad is fixed to an upper inner surface of the props or to an upper surface of the supports by fixing screws.

* * * * *